United States Patent [19]

Medeot

[11] Patent Number: 4,761,037

[45] **Date of Patent: * Aug. 2, 1988**

[54] WATER JET DEMOLITION APPARATUS AND METHOD

[76] Inventor: Renzo Medeot, via Scapacchio, 35030 Selvazzano (Padova), Italy

[ * ] Notice: The portion of the term of this patent subsequent to Jan. 20, 2004 has been disclaimed.

[21] Appl. No.: 852,177

[22] Filed: Apr. 15, 1986

Related U.S. Application Data

[63] Continuation-in-part of Ser. No. 746,954, Jun. 20, 1985, Pat. No. 4,637,656.

[30] Foreign Application Priority Data

Jul. 3, 1984 [IT] Italy ..... 21737 A/84

[51] Int. Cl.[4] ..... E21C 25/60; E01C 23/12

[52] U.S. Cl. ..... 299/1; 299/17; 299/36; 299/64; 404/91

[58] Field of Search ..... 299/1, 36, 16, 17, 64; 173/42; 403/122; 404/90, 91; 175/67

[56] References Cited

U.S. PATENT DOCUMENTS

| | | | |
|---|---|---|---|
| 3,347,597 | 10/1967 | Holifield | 299/36 |
| 3,539,234 | 11/1970 | Rapata | 308/238 |
| 3,598,446 | 8/1971 | Hatcher | 299/39 |
| 3,790,214 | 2/1974 | Kilroy | 299/17 X |
| 3,810,676 | 5/1974 | Clarke | 299/1 |
| 3,879,149 | 4/1975 | Smith et al. | 404/72 |
| 3,923,341 | 12/1975 | Miller | 299/18 |
| 3,925,038 | 12/1975 | Wiemer | 55/183 |
| 4,081,200 | 3/1978 | Cheung | 299/17 |
| 4,473,319 | 9/1984 | Spangler | 404/72 |
| 4,619,551 | 10/1986 | Juan | 299/17 |
| 4,637,656 | 1/1987 | Medeot | 299/1 |

FOREIGN PATENT DOCUMENTS

| | | | |
|---|---|---|---|
| 1959736 | 11/1970 | Fed. Rep. of Germany | 299/17 |

OTHER PUBLICATIONS

Mitsui Mining Co., Ltd., "Hydraulic Mining", 6/1975.

*Primary Examiner*—James A. Leppink
*Assistant Examiner*—Terry Lee Melius
*Attorney, Agent, or Firm*—William E. Pelton

[57] ABSTRACT

A method and apparatus is disclosed for the removal of layers of concrete, particularly from roadways and motorways. This apparatus includes one or more nozzles located at one end of respective hollow shafts each of which is supported by an articulated joint which is mounted on a movable support. The nozzles are supplied with water by means of a high pressure pump upstream of which there is positioned a preliminary treatment system for treating the water itself. The nozzles are mounted on a movable slide or frame which is controlled by an electronic circuit operable to maintain them at a predetermined height with respect to the surface to be treated. Apparatus is also provided for the elimination of possible hindrances to the free downflow of the water jets against the surface to be treated.

13 Claims, 4 Drawing Sheets

WATER JET DEMOLITION APPARATUS AND METHOD

BACKGROUND OF THE INVENTION

This application is a continuation-in-part of pending U.S. application Ser. No. 746,954 filed June 20, 1985 by the same inventor now U.S. Pat. No. 4,637,656.

FIELD OF THE INVENTION

This invention relates to a method and apparatus for demolishing structural materials and, in particular, to a method and apparatus for removing layers of hardened structural concrete from roadways through the application of pressurized water.

It is well known that studies and experiments have been carried out on the techniques for cutting or perforating stony materials, especially concrete, by means of high-pressure, or rather high-speed, water jets. However, only recently has the attention turned to the problem of removal of concrete with water jets, i.e. removing a layer of constant (or variable) thickness from a flat or curved surface, such as a roadway.

It is equally common knowledge that a good deal of research has been carried out in the attempt to resolve this problem, but with inadequate results. This is due mainly to the instability of the water jets and incorrect distance between the nozzles and the surface to be treated, and also due to limitations in the prior devices which have restricted the pattern able to be traced by the water jet nozzles as they are moved over the surface to be treated, as well as to difficulties in moving the nozzles themselves.

Another problem faced heretofore is that the instability of the water jets gives rise to the formation of surface waves which cause the production of more or less sizeable drops which are susceptible of rapidly dissipating of their energy in the air due to the high surface to volume ratio. This effect is increased by certain parameters, i.e. the high velocity of the flow, the small diameter of the jet, the sharp changes in cross-section, or the presence of dissolved gases in the liquid.

Moreover, any particulate material, such as sand or the like, present in the water being used causes rapid wear on the units. This is especially a problem when high-pressure compression units are used.

The foregoing problems have diminished the effectiveness of devices of this type heretofore and have led to the use of ever increasing water pressure, with its attendant problems, achieve the desired capacity for demolition. For example, it has been thought heretofore that water pressures below about 25,000 psi precluded effective removal of concrete and that pressures between 25,000 psi and 60,000 psi were required, as set forth in U.S. Pat. No. 4,081,200.

OBJECTS AND SUMMARY OF THE INVENTION

The purpose of this invention is to eliminate the problems previously encountered, and to create hydraulic demolition equipment which is capable of effective operation at a relatively low jet discharge speed but with high flow rates. For example, water pressure well below 20,000 psi may be used effectively.

In view of the above-mentioned purpose, one particular object of this invention is to obtain hydraulic demolition equipment in which the nozzles may be moved linearly (suitable traversing) and/or in curvilinear or rotational patterns as well as forward movement.

Another object of the invention is to obtain hydraulic demolition equipment that ensures maximum fluid stability in the jets by minimizing the tendency in the jets to dissipate their energy into relatively ineffective sprays.

A further object of the invention is to obtain hydraulic demolition equipment in which the nozzles are constantly kept at the optimum distance from the surface of the concrete to be treated.

The above-mentioned object, along with the objects outlined previously and others that will be apparent to those skilled in the art are attained with the hydraulic demolition equipment described herein, which comprises at least one water jet nozzle placed at the end of a hollow support rod which is movably carried by a suitable frame member. The rod is mounted in the frame by an articulated joint, such as a ball or cardan joint, and is interconnected with a suitable controller for effecting movement of the nozzle in a variety of predetermined patterns across the surface to be treated. Each nozzle is fed with water by means of high pressure pumps upstream from which there is a plant for prior degassing of the water and, where necessary, for filtering the water itself. The frame member which carries the nozzle is also adapted for movement vis-a-vis the surface being treated. Its position is electronically monitored and a suitable controller keeps it at a predetermined or optimal distance from the concrete being treated. A system is also provided for eliminating any obstruction to the free flow of the water jet against the surface to be treated.

BRIEF DESCRIPTION OF THE DRAWINGS

Further features and advantages of the hydraulic demolition equipment discussed here may be better understood with the aid of the following description of one preferred way of making and using the present invention, illustrated for guidance only in the following drawings, in which.

BRIEF DESCRIPTION OF THE PREFERRED EMBODIMENT

Figure 1:
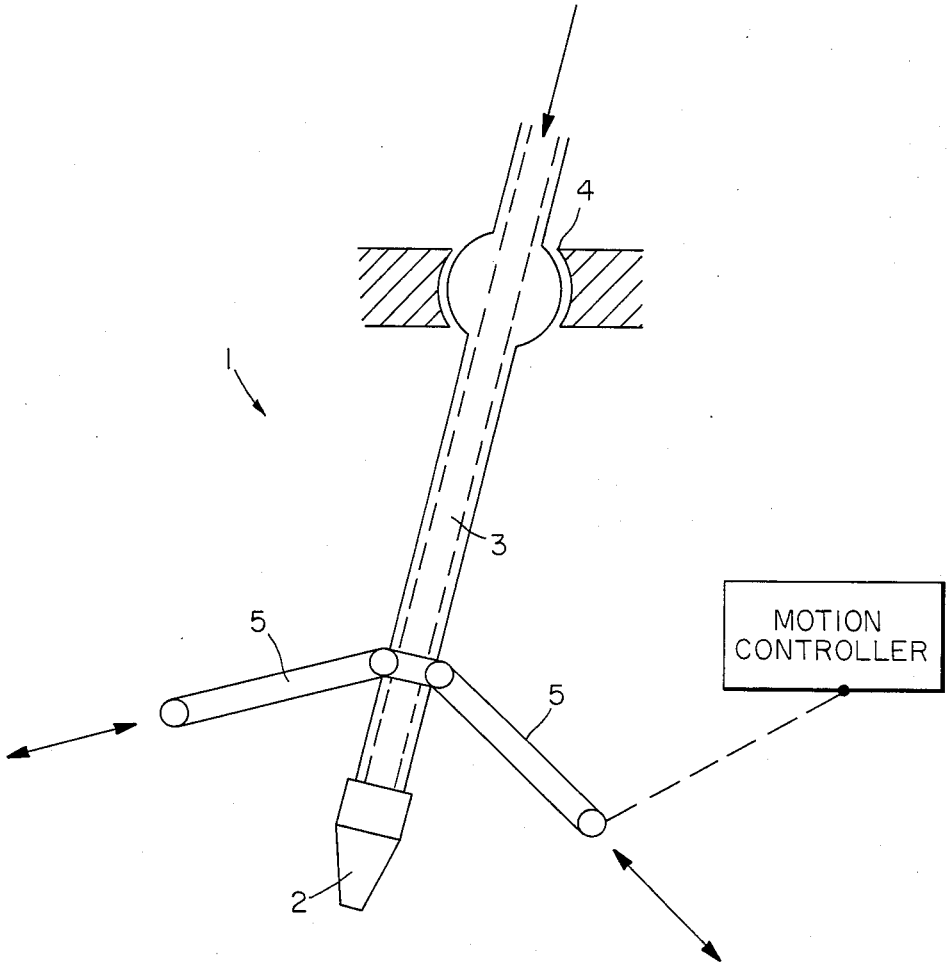
FIG. 1 is a diagram of one of the treatment heads or nozzles with its supporting structure and movements.

With reference to the numerical symbols on the various figures in the enclosed drawings, the hydraulic demolition equipment indicated as a whole by 1 is made up of at least one nozzle 2 mounted on the end of a hollow rod 3 supported by a spherical (or cardan) articulated joint 4 so that it can attain the movements induced in it by suitable linkage elements 5, which may be connecting rods, cams or the like. Generally, an array of such nozzles (not shown), which may consist of three or more, is used to obtain more efficient treatment results.

The connecting elements 5, whether links, rods, cams or the like are controlled by a suitable controller 5*a* which may be programmed in a conventional way, either electrically or mechanically, to predetermine the motion of or the pattern to be traced by each nozzle 2 as it passes over the surface being treated. This allows for all kinds of cyclic movement, as desired. For example, the nozzles may be moved to trace a straight line or traversing pattern, or they may trace a circular or curvilinear or elliptical pattern created to suit the particular circumstances and to obtain optimum results. The nozzle, which is preferably constructed of a sintered material, may be provided with an internal passage which in cross-section appears to have a converging/diverging shape similar to a Venturi tube.

To avoid the negative effects of the presence of gases which tend to break up the water jet as they develop inside the nozzle (lowest pressure point), the water is first degassed by a special plant 6 placed upstream from the high-pressure pumps (not specifically shown here). The pumps are used to pressurize the water to be fed to the nozzles to pressures well below 25,000 psi. For example, effective treatment of concrete has been obtained at water pressures of approximately 15,000 psi or less down to approximately 10,000 psi., depending upon the characteristics of the surface to be treated.

Figure 2:
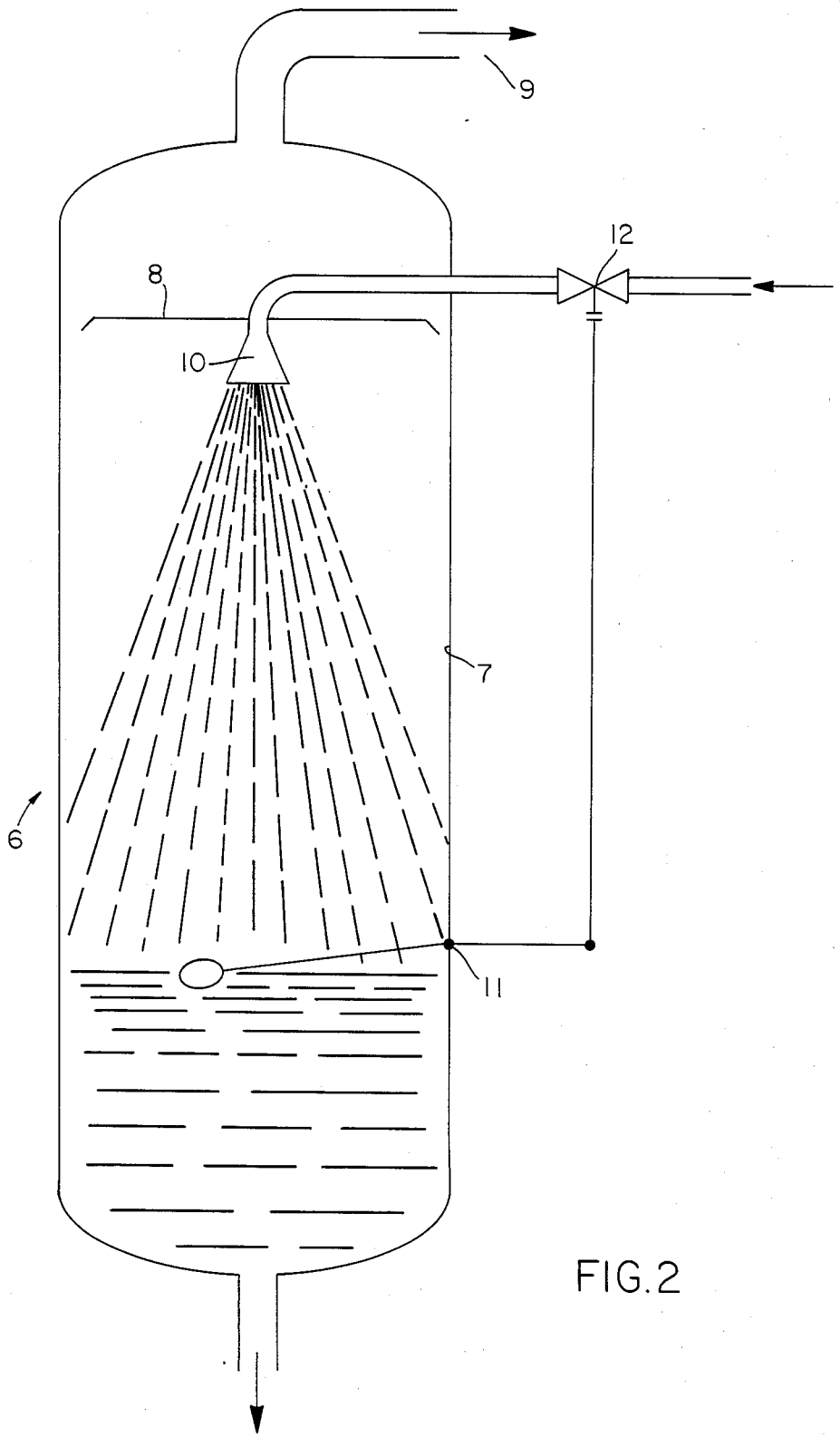
FIG. 2 shows the degassing plant for pre-treating the water destined for the feeding pumps.

This plant (FIG. 2) includes a tank 7 of a special elongated shape, containing a screen 8 for preventing liquid drops produced by a blowing or spray inducing apparatus 10 from passing to suction unit 9 which induces a partial vacuum in the tank at predetermined pressures. The suction unit 9 is suitable equipment of a well-known type. Inside the tank there is also a level adjuster 11 which opens or closes a water input valve 12 in order to keep the water level relatively constant inside the tank.

In practice, since the solubility of gases in the treatment liquid is inversely proportional to its temperature and directly proportional to ambient pressure, when the above-mentioned plant brings the pressure down well below atmospheric pressure (assuming that the source of the water is a river, lake or available municipality water supply) there is a considerable release of gases from the water in the tank 7. This is facilitated by the use of the spray head 10, which in generating a spray or bubbling in the input flow of water, effectively increases the air/liquid exchange surface and therefore the speed at which gases are released from the liquid.

It has been found that the efficiency of the treatment varies according to the distance between the nozzle and the surface to be treated. Where the treatment requires the nozzle to be close to the surface, there is risk of damage to the nozzle, particularly when the surface to be treated presents considerable irregularities. As a result, it was necessary heretofore that the nozzle be maintained at a sufficiently great distance from the treated surface to be safe and to avoid its being damaged by the largest defects or irregularities in the surface. Since the safe distance is not always the optimum distance for effective demolition, the requirement to maintain a safe distance reduces the efficiency of the prior types of equipment and results in undesirable variation in surface treatment from one place to another.

Figure 3:
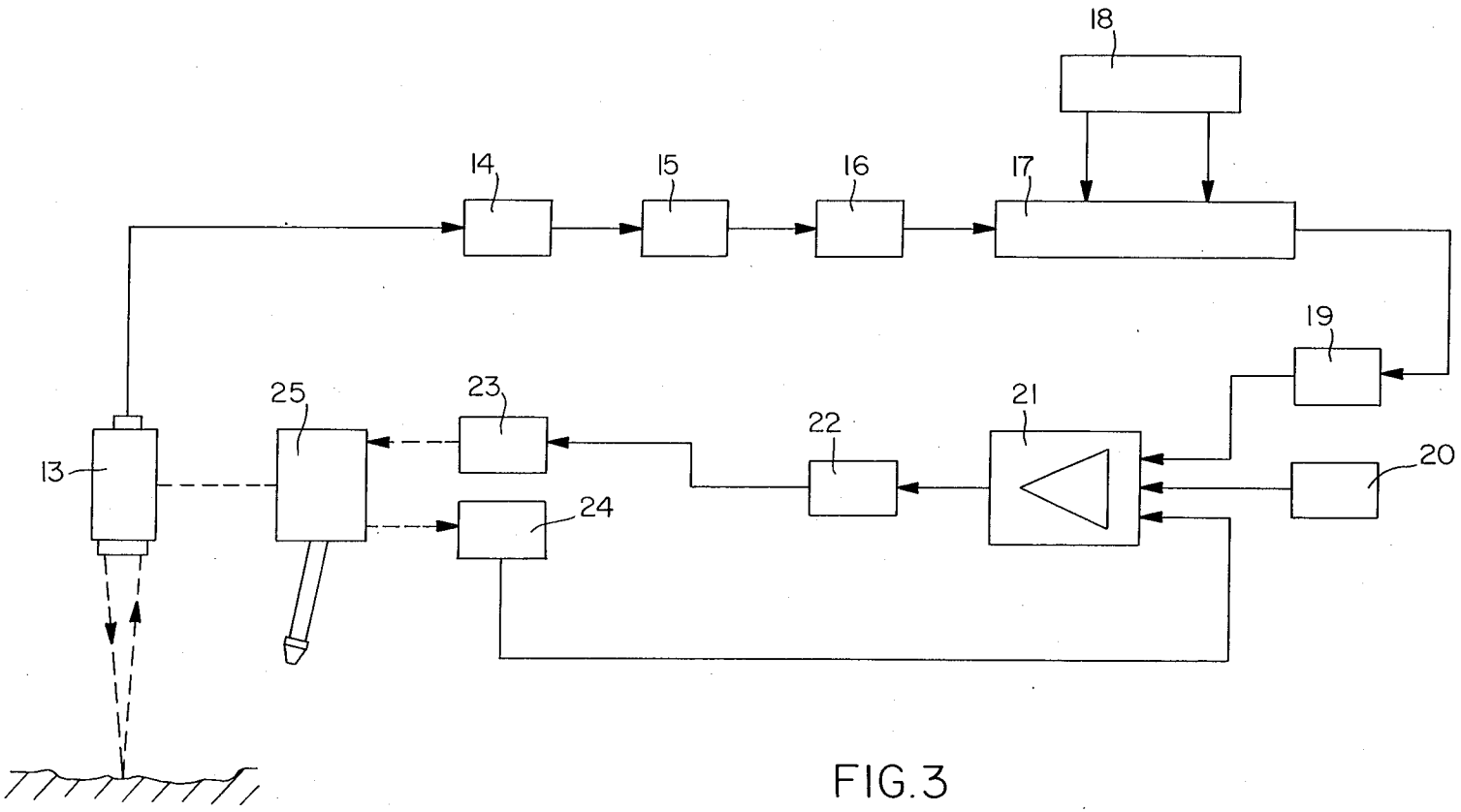
FIG. 3 is a schematic in block diagram of circuitry for monitoring and controlling the distance of the treatment heads from the surface to be treated.

To eliminate this drawback, the present invention provides a nozzle-holder frame which is mounted for movement toward and away from the surface to be treated. The position of the frame relative to the surface is automatically adjusted to accommodate the surface conditions of the concrete. As shown in FIG. 3 for example, automatic height control is facilitated by a height transducer 13 which is positioned ahead of the nozzle in the direction of travel and detects the surface characteristics or topography of the surface which is to be demolished. The transducer 13 may comprise any well known device and can operate optically, by radar, acoustically, or by laser, as desired, so long as it produces a signal that indicates the relative distance between the concrete surface and a known reference point on the nozzle-holder frame.

The signal produced by the transducer 13 is, therefore, proportional to the distance between the surface of the concrete and the nozzle-holder frame and is provided without any mechanical contact between the transducer itself and the surface of the concrete. As described hereinabove, this feature protects the transducer which, during the correct operation of the automatic height-adjusting device, moves parallel to the concrete surface to be treated which is well known to be rather rough and may be quite irregular.

The height measurement is therefore obtained indirectly by the transducer which, as indicated above, may make use of the propagation of ultrasonic pressure waves or the reflection of suitable luminous beams (laser). The signal, which is proportional to the distance from the nozzle-holder frame, is fed to a minimum reading circuit 14, which may comprise a signal level limiter, the detailed construction of which is not critical to the practice of the present invention. The circuit 14 principally provides two functions: first, it integrates the analog signal coming from the height transducer 13 with a time-averaging circuit, in order to eliminate either electrical disturbances, or any instability of the signal itself due to external agents such as concrete particles, water jets, and so on; second, it picks up the minimum value of the signal, such value being updated at regular time intervals so as to reproduce the surface profile of the concrete.

The output from the minimum reading circuit 14 is fed to a sample and hold circuit 15 of the well-known kind, which serves to quantize the continuously varying signal from the transducer. The quantized output from the sample and hold circuit 15 is fed to an analog-to-digital converter 16, which produces a digital output signal. This digital output can be in any desired format, such as an 8-bit PCM format.

The circuits 14 and 15, together with the analogue-to-digital converter 16, provide suitable "sampling" of the transducer output signal in proportion to the distance between the surface being treated and the nozzle-holder frame 25.

The sampled signal in digital form is fed to a memory or register 17 where it is stored for subsequent use when the nozzle, which preferably travels a known distance behind the transducer, reaches the point just previously measured. The memory 17 therefore, must have a capacity sufficient to store an adequate number of readings along the whole extent of the passage of the distance between the transducer and the nozzle.

The location of the digital detected measurement in the memory 17 is controlled by a synchronizing circuit such as a read/write controller. The controller 18 can provide read/write addresses for the memory 17, thereby synchronizing the timing of the reading of signals in the register 17 so that suitable adjustment of the actual height of the nozzle-holder frame can be made in time to permit the trailing nozzle to be at its optimum height when it reaches the point that was previously measured by the transducer 13. By retaining previously measured height values in a memory, the system can be stopped and restarted at a later time while still controlling optimum nozzle height, provided the nozzle position is not changed.

The operation of the synchronizing circuit 18 is based on two signals provided by an incremental encoder, the results of which are used for mechanical control over the horizontal movement (parallel to the concrete surface) of the nozzle-holder frame 13.

As known, an incremental encoder generates square-wave pulses on two channels, shifted ±90° out of phase one from the other. The sign of the shift out of phase depends on the movement direction, and the pulse number is proportional to the width of the movement itself. A bidirectional (up-down) counter collects these square-wave pulses and provides univocal information about the position of the nozzle-holder frame with respect to the concrete surface.

This digital information represents an "address" at which data coming from the sampling circuit will be stored within the memory register. The memory register is composed of two shift-subregisters; the first is a "serial in—parallel out" type, and collects data coming from the sampling circuit; the other, being a "parallel in—serial out" type, releases data towards the digital to analog converter 19. At each direction inversion of the horizontal movement of the nozzle-holder frame, the content of the first subregister is "copied" into the second one.

In this way, as the transducer reading is read out from the memory register, it can be compared to the signal representing the value of the height of the nozzle-holder frame at that moment. Such comparison is more easily accomplished with analog signals, so the output from the memory 17 is fed to a digital-to-analog converter 19.

The digital-to-analogue converter 19, together with a multi-input comparator circuit 21, provides a comparison between the data extracted from the memory 17, a reference signal from a reference signal generator 20 corresponding to the desired height and the height value of the current position of the nozzle-holder frame. The latter value is given by a nozzle position transducer 24. Because the optimum nozzle height can vary depending upon the kind of surface present, the depth of desired treatment, and the rate of nozzle travel, for example, the reference signal generator 21 is variable and can comprise a voltage source and variable resistor. The comparison circuit 21 operates to determine the magnitude of the necessary height change by comparing the future height with the actual height and then comparing the required change with the reference to determine the direction, up or down, of the nozzle movement to be made. The nozzle position transducer 24 is mechanically linked to the nozzle and provides a signal representing the real-time position of the nozzle. This transducer can comprise a potentiometer and a voltage source or can be as complex as an optical encoder.

The result of the comparison is sent to a logical control circuit 22 which translates this signal into a control signal for a dynamic fluid actuator 23. The actuator 23 provides the amount of mechanical motion necessary to correct or adjust the height of the nozzle-holder frame 25 relative to the concrete surface.

The comparator 21, which may comprise a microprocessor, together with the circuit 22, compute whether the nozzle-holder frame will go up or down as follows: the frame will be directed to go up if the initial value of the signal from the circuit 19 and the value of the reference signal 20 is greater than the actual value of the signal from the circuit 24 plus a threshold value; the frame will be directed to go down if the initial value of the signal from the circuit 24 minus the difference between the value of the signal from the circuit 19 and the value of the reference signal 20 is less than the actual value of the signal from the circuit 24 minus the threshold.

Figure 4:
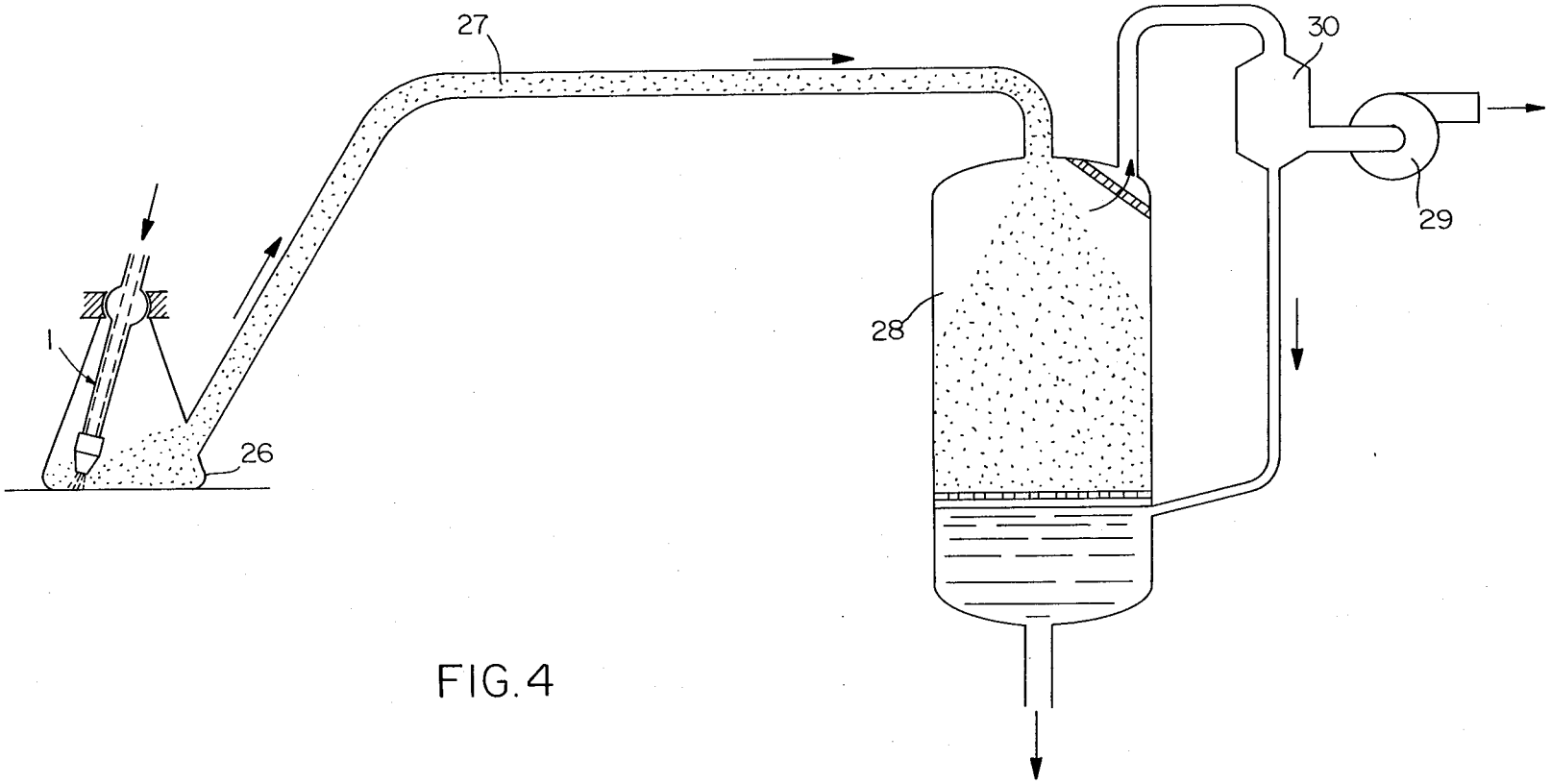
FIG. 4 shows a plant for eliminating the debris and waste water from the surface being treated.

The efficiency of the water jet is drastically reduced by the concrete debris or rubble and the waste water remaining within the jet's operating range. Accordingly, it is desirable to remove rapidly the rubble, debris and waste water from the treatment location area by suitable means such as a sturdy suction plant. As shown in FIG. 4, there is provided a suction hood 26 which surrounds the treatment head and is connected by means of a flexible hose 27 to a debris-storage and water-separation tank 26 where a low pressure is kept by means of a fan 29. The fan 29 can be operated by the same motor that works the high-pressure pumps, as desired. A centrifugal separator 30 is provided to prevent passage of suspended water drops.

The above-described suction plant not only increases efficiency, it also provides the following advantages:

(a) the removal and storage of waste material, thus eliminating a tiresome operation;

(b) the retrieval of water for possible re-use, which is very important in areas where water is scarce, also (especially in the case of roadways) avoiding the flooding of nearby lanes which sometimes remain open to traffic; and (c) the creation of a low pressure point for connecting to the degassing plant (6).

In practice, this equipment makes it possible to:

(a) eliminate all worn concrete without damaging hard, sound concrete, even in the presence of metal reinforcement which benefits from the removal of rusty deposits during the process;

(b) avoid vibrations and any other damaging effects on the structure, consequently reducing noise to tolerable levels;

(c) create a highly-wrinkled surface, even with cavities produced by the undermining of rounded aggregate, which greatly improves the grip of the new concrete; and (d) eliminate the formation of fumes and dust which occurs with traditional methods.

It is clear from the above description and from the enclosed drawings that the hydraulic demolition equipment of this invention is highly practical and efficient to use.

The equipment is described and illustrated herein by way of example only, and the invention is not to be limited thereby. The embodiments set forth herein are provided only with a view to demonstrating the practical feasibility and general features of the invention, which may the altered and improved on the basis of expert knowledge of this field, without departing from the scope of the innovative concepts explained above. For example, the pressure needed for the water jets may be obtained in one or more stages, each of which may or may not be preceded by a degassing plant with a filtering system, where necessary.

What is claimed is:

1. Hydraulic demolition apparatus comprising a nozzle at one end of a hollow rod, said rod being supported by an articulated joint and connected to a device provided movement; at least one high-pressure pump for supplying water to said nozzle; means for degassing the water supply to said nozzle upstream from said pump; said degassing means comprising an elongated tank, a filtering system and a spray inducing element arranged for spraying water into said tank, said tank having a screen for preventing the drops produced by said element from passing out of said tank and a level adjuster which controls the input of water to said spraying means; means for keeping said nozzle at a constant preset distance from the surface to be demolished; and means for eliminating substantially all obstacles to the free flow of the water jet against the surface to be demolished.

2. The apparatus of claim 1 in which said articulated joint comprises a cardan whereby said nozzle follows the movements provided by said movement device.

3. The apparatus of claim 1 in which said nozzle is made of sintered material, and is provided with an internal passage having a converging/diverging cross-sectional shape.

4. The apparatus of claim 1 comprising, in addition, means for automatically positioning said nozzle at a predetermined distance from the surface to be demolished regardless of the shape of the surface, said positioning means comprising means for detecting the height of the nozzle and dynamic fluid means for adjusting the height of the nozzle.

5. The apparatus of claim 1 comprising in addition, means for sucking up the water and debris from the treatment area, comprising a suction hood surrounding said nozzle and connected by a flexible hose to a storage tank where a low pressure is kept by means of a fan, said storage tank also including a centrifugal separator for avoiding the passage of drops of water in suspension.

6. A method for demolishing a surface comprising the steps of:

substantially degassing a supply of water including the steps of spraying water inside a tank having a screen therein for preventing the drops produced by the spray from passing out of the tank, sensing the level of water in the tank, and controlling the input of water to be sprayed in accordance with the sensed level of water in the tank;

pressurizing the water;

feeding the pressurized water to at least one treatment nozzle for ejection at the surface;

moving said nozzle across the surface in a predetermined pattern; and maintaining distance between said nozzle and the surface at a predetermined amount while continuously adjusting the path of said nozzle to conform the topography of the surface.

7. The method of claim 6 comprising the step of moving said nozzle in a curvilinear pattern across the surface to be demolished.

8. The method claim 6 comprising the step of moving said nozzle in an essentially elliptical pattern.

9. The method of claim 6 comprising the step of moving said nozzle in an essentially circular pattern.

10. The method of claim 6 comprising pressurizing the degassed water in the range of approximately 10,000 psi to approximately 25,000 psi.

11. The method of claim 6 comprising pressurizing the degassed water to values in the range of from approximately 10,000 psi to approximately 15,000 psi.

12. The method of claim 6 comprising collecting and removing waste water and debris from the vicinity of said nozzle.

13. Apparatus for demolishing a surface, comprising:

means for substantially degassing a supply of water within a tank including a spray inducing element for spraying the water into said tank, said tank having a screen for preventing the drops produced by said spray inducing element from passing out of said tank and having a level adjuster which controls the input of water to said spray inducing element;

means for pressurizing the degassed water;

means for feeding the pressurized water to at least one treatment nozzle for ejection at the surface;

means for moving said nozzle across the surface in a predetermined pattern; and means for maintaining the distance between said nozzle and the surface at a predetermined amount while continuously adjusting the path of said nozzle to conform to the topography of the surface.

* * * * *